US005606335A

United States Patent [19]

English et al.

[11] Patent Number: 5,606,335

[45] Date of Patent: Feb. 25, 1997

[54] PERIODIC SURFACES FOR SELECTIVELY MODIFYING THE PROPERTIES OF REFLECTED ELECTROMAGNETIC WAVES

[75] Inventors: Errol K. English, Beaver Creek; William J. Leeper, Huber Heights, both of Ohio

[73] Assignee: Mission Research Corporation, Dayton, Ohio

[21] Appl. No.: 686,198

[22] Filed: Apr. 16, 1991

[51] Int. Cl.[6] ..... H01Q 15/02

[52] U.S. Cl. ..... 343/909; 343/753

[58] Field of Search ..... 343/909, 872, 343/756, 753; H01Q 19/06, 19/00, 15/02, 15/24

[56] References Cited

U.S. PATENT DOCUMENTS

| | | | |
|---|---|---|---|
| 2,636,125 | 4/1953 | Southworth | 343/909 |
| 3,769,623 | 10/1973 | Fletcher et al. | 343/909 |
| 4,228,437 | 10/1980 | Shelton | 343/909 |
| 4,301,456 | 11/1981 | Lovick, Jr. | 343/909 |
| 4,518,967 | 5/1985 | Westerman | 343/770 |
| 5,357,260 | 10/1994 | Roederer et al. | 343/909 |

FOREIGN PATENT DOCUMENTS

| | | | |
|---|---|---|---|
| 564609 | 10/1958 | Canada | 343/753 |
| 60-81902 | 5/1985 | Japan | 343/756 |

OTHER PUBLICATIONS

Yee et al., "Absorptive Sidelobe Filter", Conference: B521982 APS International Symposium Digest Antennas and Propagation Albaquerque MN, USA (24–28 May 1982), pp. 691–694.

*Primary Examiner*—Hoanganh T. Le
*Attorney, Agent, or Firm*—Biebel & French

[57] ABSTRACT

To reduce strong diffractive fields at the baseline edge of a metal body which is reflective of electromagnetic radiation, a substrate substantially transparent to the radiation is placed contiguous to that edge. Conductive reflective elements are carried on an exposed surface of the substrate, in a pattern such that reflection decreases and transparency increases from the baseline toward the terminal edge of the substrate. Thus the diffractive field is gradually reduced.

11 Claims, 6 Drawing Sheets

PERIODIC SURFACES FOR SELECTIVELY MODIFYING THE PROPERTIES OF REFLECTED ELECTROMAGNETIC WAVES

FIELD OF THE INVENTION

This invention relates to periodic surfaces which modify the properties of reflected electromagnetic waves.

BACKGROUND OF THE INVENTION

Electromagnetic radiation incident on reflective surfaces is reflected according to known and well understood principles. These principles are widely used in design of antennas and test bodies, as well as in receivers for radar systems.

One set of problems presented by these principles becomes important at the termination edge of a reflective surface. There, where it terminates abruptly, will be a very strong diffracted field. It is quite perceptible when the reflective body is illuminated by the radiation, and facilitates detection of the surface and its body. Also, where these edges occur in antenna, undesirable sidelobes and backlobes are created, which can seriously perturb the focused fields in the testing or quiet zone.

It is an object of this invention to provide a reflective surface which reduces the abruptness of the terminal edge, thereby substantially eliminating the diffractive field of a reflected wave at that edge. This renders the terminal edge less visible, and in some applications greatly reduces the formation of backlobes and sidelobes.

Another set of problems presented by these principles resides in the fact that the size of a continuous metal object is readily deducible from the properties of the reflected radiation. It can be useful to change the perceived size of a body, not only to confuse an observer, but to provide for versatility of design. It is therefore another object of this invention to provide a surface which behaves as a piece of metal that changes its perceived size and response as a function of the frequency of radiation incident on it.

This invention provides both for diffraction control, and for frequency compensation, and can provide the foregoing advantages.

BRIEF DESCRIPTION OF THE INVENTION

This invention is accomplished with the use of a tapered periodic surface. The term tapered periodic surface ("TPS" herein) means a transmissive body having a face on which there is provided a group of reflective elements, preferably wire-like, that are spaced apart from and are parallel to one another, and whose lengths are smaller nearer the terminal edge of the periodic surface than at its baseline edge. The baseline edge is contiguous with the baseline edge of a reflective body.

According to one embodiment of the invention, the elements extend from edge to edge in lines, reducing in individual length toward the terminal edge of the TPS. This will sometimes be referred to as a "parallel-type" TPS.

According to another embodiment of the invention, the elements are parallel to the edges in lines, and are shorter in individual length toward the terminal edge. This will sometimes be referred to as an "orthogonal-type" TPS.

These two types of TPS can be superimposed on one another if desired.

The gradual reflective transition from an abrupt metal edge to the terminal edge reduces the diffraction effect by gradually, rather than abruptly, reducing the proportion of the reflected field. Instead, an increasing amount is transmitted. Thus, there is little scatter of the radiation at the terminal edge, and there is a field of "tapered" reflection that is quite orderly and less noticable and disruptive.

Because the TPS is a periodic surface, it is frequency sensitive. It is "metal" at one edge, and "not metal" at the other. There is a point at which the transition is at its halfway point or 3 dB point, and the location of this point on the TPS varies with the frequency of the incident radiation, rather than on the structure of the TPS itself. The effective length of the TPS acting as a metal can increase or decrease with frequency, and can be a basic building block for many broadband applications, in which a perceived dimension is different from the actual dimensions, and which can confuse detectors.

The above and other features of this invention will be fully understood from the following detailed description and the accompanying drawings, in which:

DETAILED DESCRIPTION OF THE INVENTION

Figure 1:
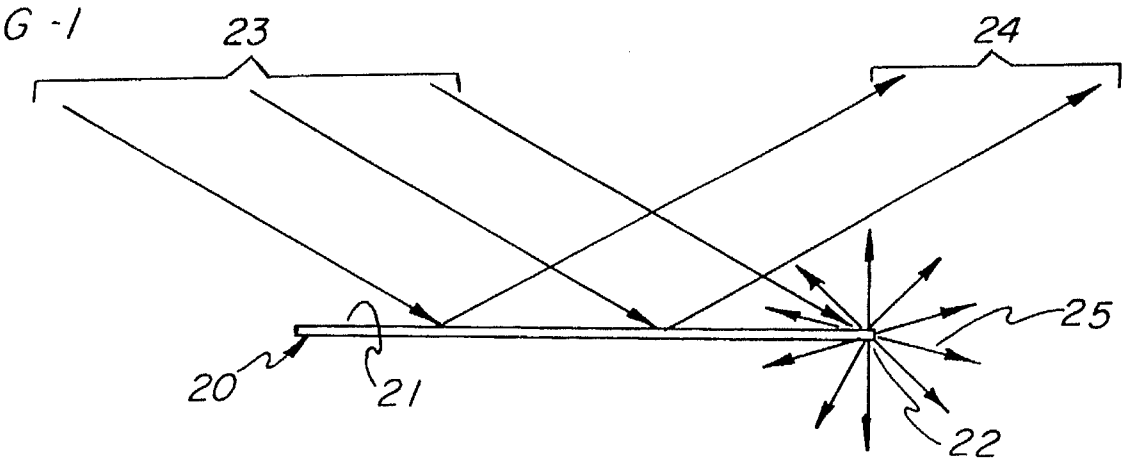
FIG. 1 is a side schematic view showing a disadvantage of the prior art.

One type of disadvantage of the prior art is shown in FIG. 1. A reflective metal plate 20 has an area 21 with a baseline edge 22. An incident field 23 of electromagnetic radiation is shown impinging on area 21 and reflecting as a reflective field 24. However, at the baseline edge, the incident field is strongly diffracted as a diffracted field 25. This diffracted field is very visible, and constitutes a substantial perturbation of the reflected field at the baseline edge.

Figure 2:
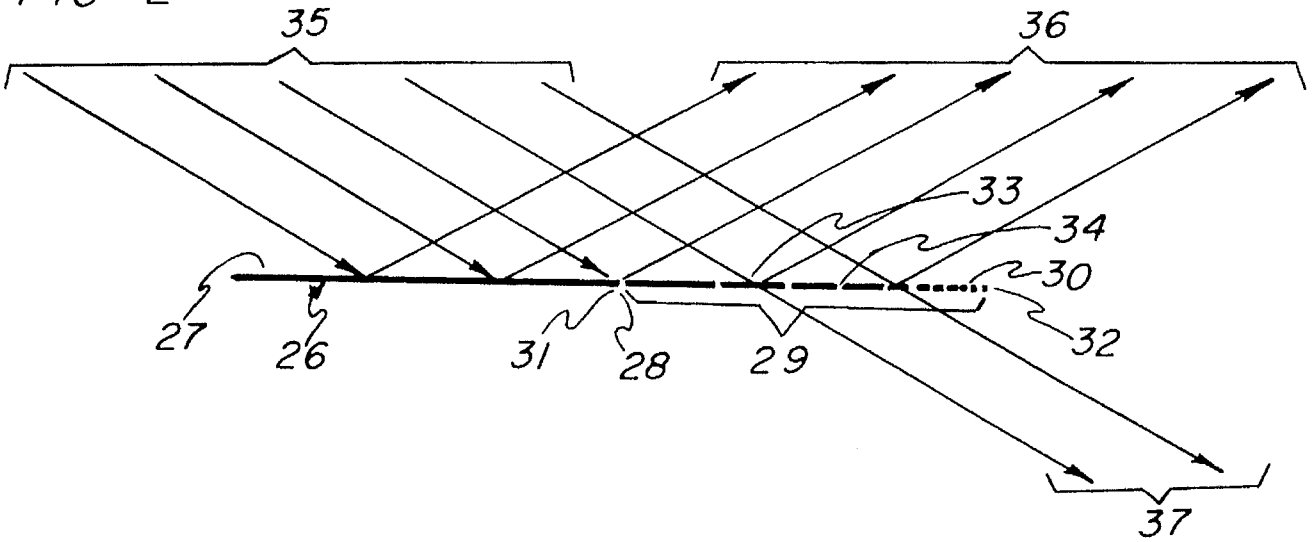
FIG. 2 is a side schematic view showing some advantages of this invention.

FIG. 2 shows a similar reflective metal plate 26 having an area 27 and a baseline edge 28. It is modified according to this invention by a tapered periodic surface (TPS) 29 attached to, or otherwise continuing the plate from the baseline edge. The TPS has a surface 30 which extends from its baseline edge 31 to terminal edge 32.

The detailed construction of the TPS will be described in full detail later. For purposes of illustrating the invention, it will be noted that reflective elements 33 of various lengths, with spacings 34 between them, are mounted on a substrate (not shown in FIG. 2). The substrate is transmissive to incident electromagnetic radiation, while the elements are reflective to it.

Incident field 35 is shown impinging on both area 27 of metal plate, and on TPS 29. The left hand portion of the incident field in FIG. 2 is shown being fully reflected as part of reflected field 36. However, only part of the incident field is reflected by the TPS. The other part passes through the transparent portions of the TPS as a transmitted field 37. As will later be seen, as the reflected field approaches the terminal edge, a progressively greater portion of the incident field is transmitted, and a progressively lesser portion is reflected. Thus, there is a "tapered" effect and an absence of an abrupt edge termination. As a consequence, diffraction at either the baseline edge or at the terminal edge is largely eliminated.

Figure 3:
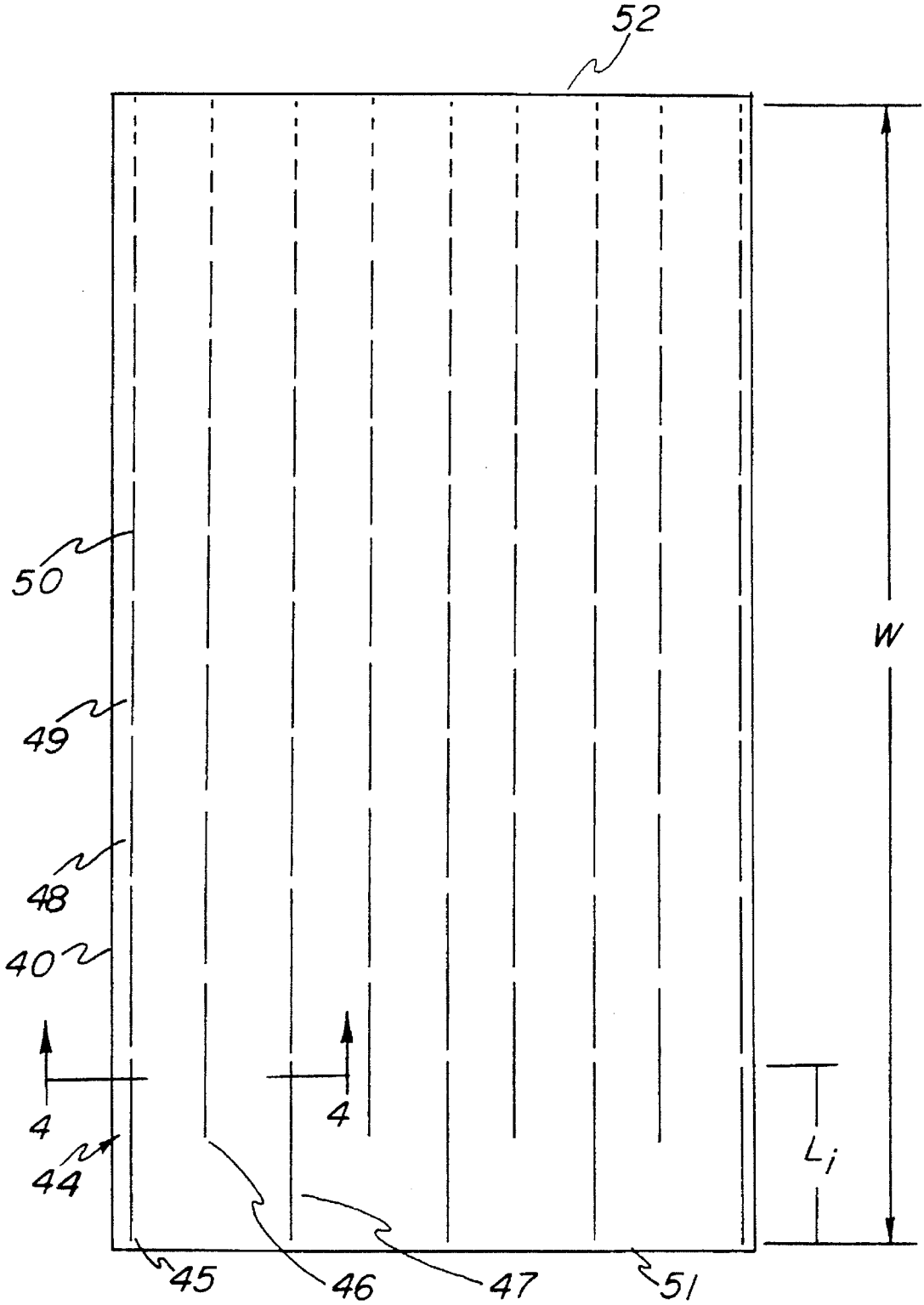
FIG. 3 is a plan view of one embodiment of the invention.
Figure 4:
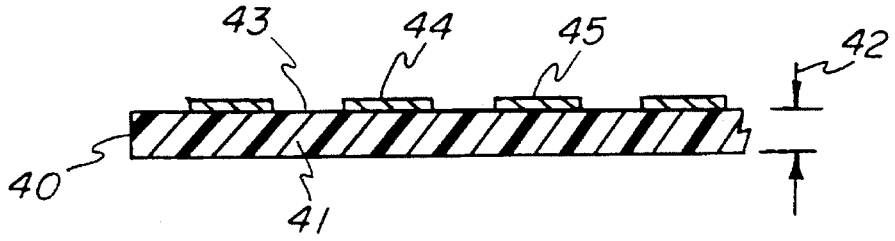
FIG. 4 Is a fragmentary cross section taken at line 4—4 in FIG. 3.

FIGS. 3 and 4 illustrate the presently-preferred embodiment of TPS 40. A base 41, transmissive to the radiation being responded to, has a dimension 42 of thickness, and an upper area 43. Reflective elements 44, preferably linear, are grouped in lines such as lines 45, 46, 47. The lines are spaced apart, and elements such as elements 48, 49, 50, in the same line are spaced apart from one another.

The TPS has a baseline edge 51 that is placed in abutment with the baseline edge of a metal conductor, such as plate 26 in FIG. 2, and in this application lies in the same plane.

The lengths of the individual elements in the same line gradually decrease as the line extends from the baseline edge 51 to a terminal edge 52 of the TPS. For dimension reference purposes, the width of the TPS is shown as W, and the length of the respective elements is shown as Li.

If desired, the elements could be lengths of wire adhered to or embedded in the base. For many applications, metal may be applied by stenciling or deposition techniques. While the respective elements in all of the lines could be aligned, for many applications, a skewed arranged will be preferred. This is shown in FIG. 3. The TPS arrangement in FIG. 3 is referred to as a skewed arrangement. It is also a "parallel-type" TPS.

Figure 5:
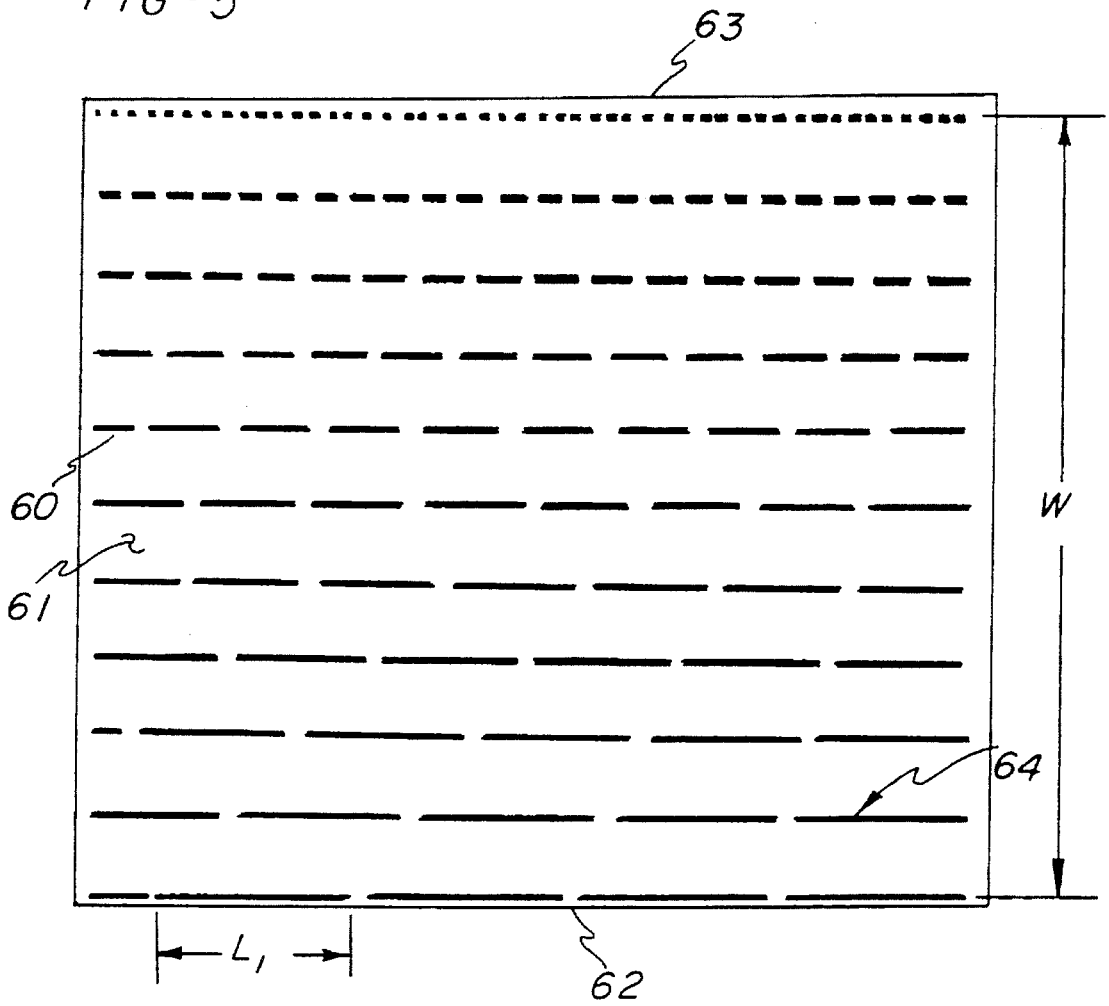
FIG. 5 is a plan view of another embodiment of the invention.

FIG. 5 shows a TPS 60 of the type referred to herein as an "orthogonal-type" TPS. This type has a base 61 like base 41 in FIG. 3. It has a baseline edge 62 and a terminal edge 63. The baseline edge is abutted to a metal plate (not shown). In this embodiment the lines 64 of reflective elements extend laterally relative to the width W of the base, rather than parallel to it. Otherwise it is identical in construction to that of FIG. 3.

Figure 13:
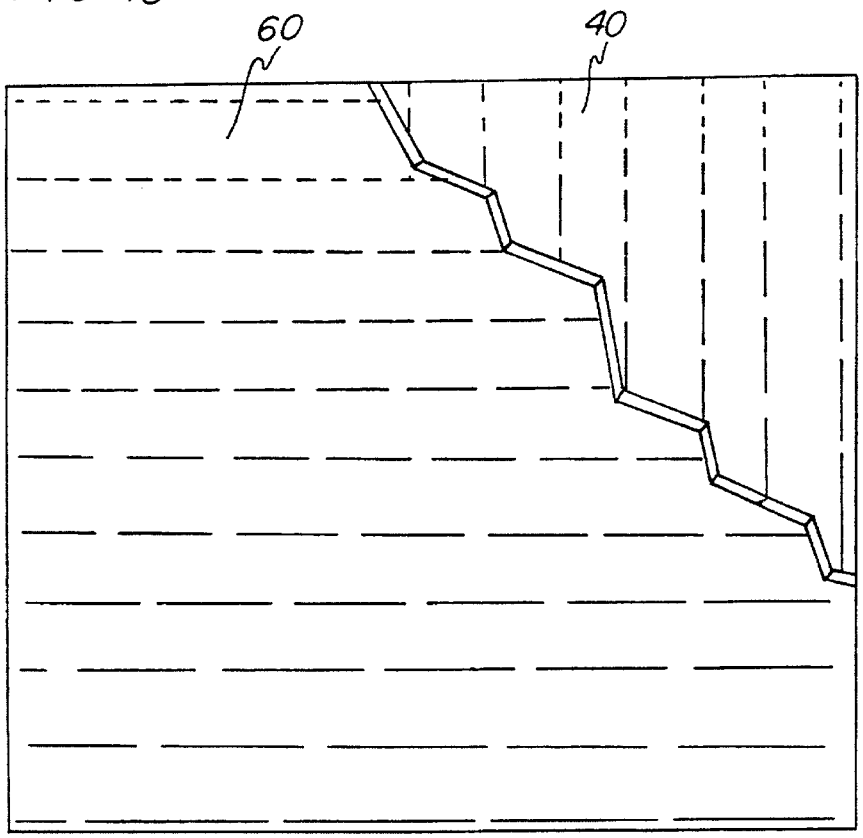
FIG. 13 is a schematic plan view showing a parallel TPS, the view being partially broken away to show an orthogonal TPS, the parallel and orthogonal TPS being superimposed on one another.

As illustrated in FIG. 13, for some applications, the parallel type TPS 40 and an orthogonal type TPS 60 can be superimposed on one another.

Figure 6:
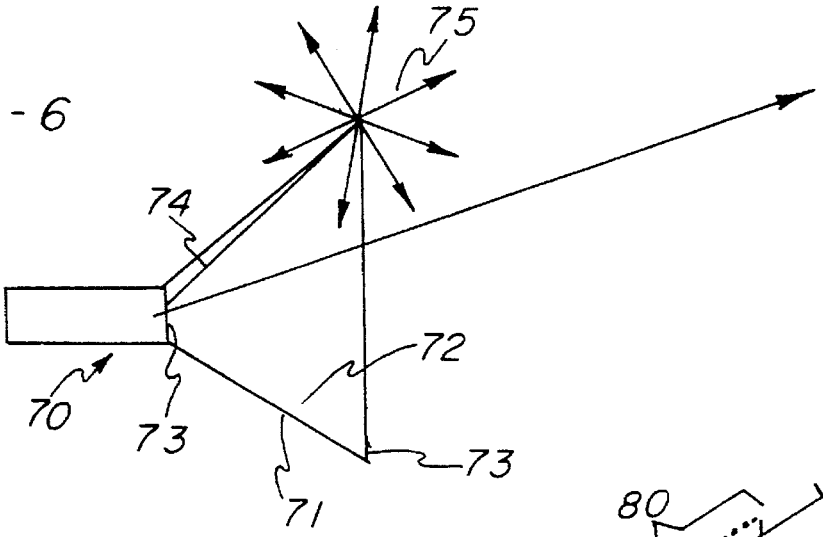
FIG. 6 is a schematic axial cross-section of a horn antenna showing a disadvantage of the prior art.

FIG. 6 is an axial cross-section showing a conventional horn antenna 70. It has a metal body 71 with a frusto-conical reflective metallic surface 72 and a baseline edge. An emission source 73 projects incident rays 74 which impinge on surface 72 as an incident field, and upon its baseline edge when there is created a diffractive field 75 as in FIG. 1. The objections are evident.

Figure 7:
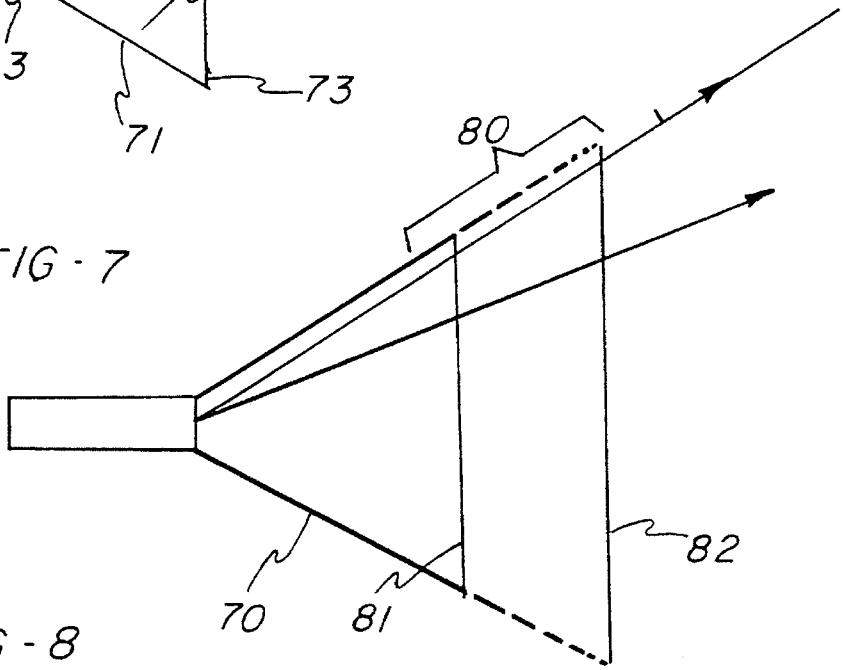
FIG. 7 is a schematic axial cross-section of a horn antenna modified with this invention.

FIG. 7 shows antenna 70 modified with a TPS 80 of the same construction as any of those already described. TPS 80 is frusto-conical, having a baseline edge 81 in abutment with surface 72, and continuing it, and a terminal edge 82, where there is no (or very little) diffracted field due to the presence of the TPS.

Figure 8:
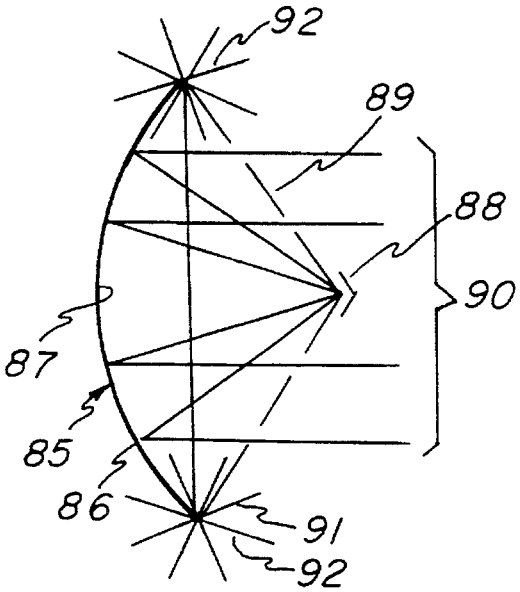
FIG. 8 is a schematic axial cross-section of a parabolic reflector showing a disadvantage of the prior art.
Figure 9:
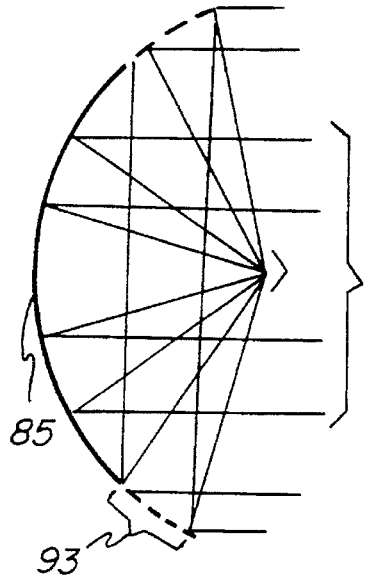
FIG. 9 is a schematic axial cross-section of a parabolic reflector modified with the invention.
Figure 10:
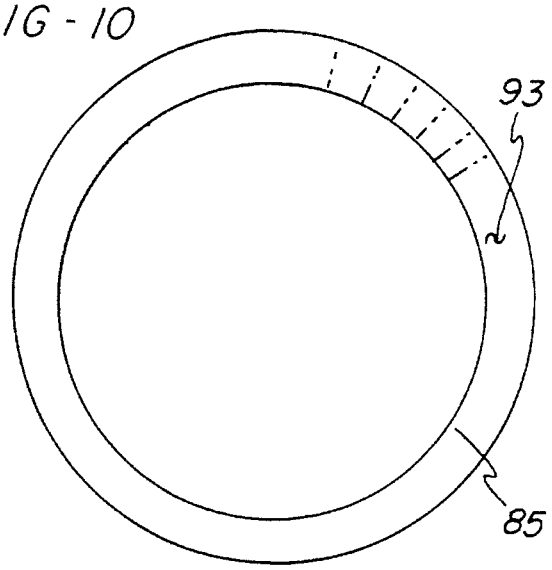
FIG. 10 is a partial right hand view of FIG. 9 further illustrating the modification of FIG. 9.

FIGS. 8–10 show a parabolic reflector 85 having a solid metallic body 86 with a reflective surface 87 shaped for appropriate reflection to form a focussed or directed beam. A source 88 such as a feed antenna is appropriately placed relative to the reflector to provide an incident beam or array 89, which is reflected as a focussed field 90. Notice that at the baseline edge 91 of the reflector, in the absence of a TPS, there is a diffractive field 92.

In FIGS. 9 and 10, the reflector 85 is shown provided with an appropriately shaped TPS 93. It will usually constitute a geometric continuation of the shape of the reflector. It has the same construction as any of the TPS shown in FIGS. 3–5, except for its gross structural shape. Its consequence is the elimination, or near elimination, of the diffracted field.

Figure 11:
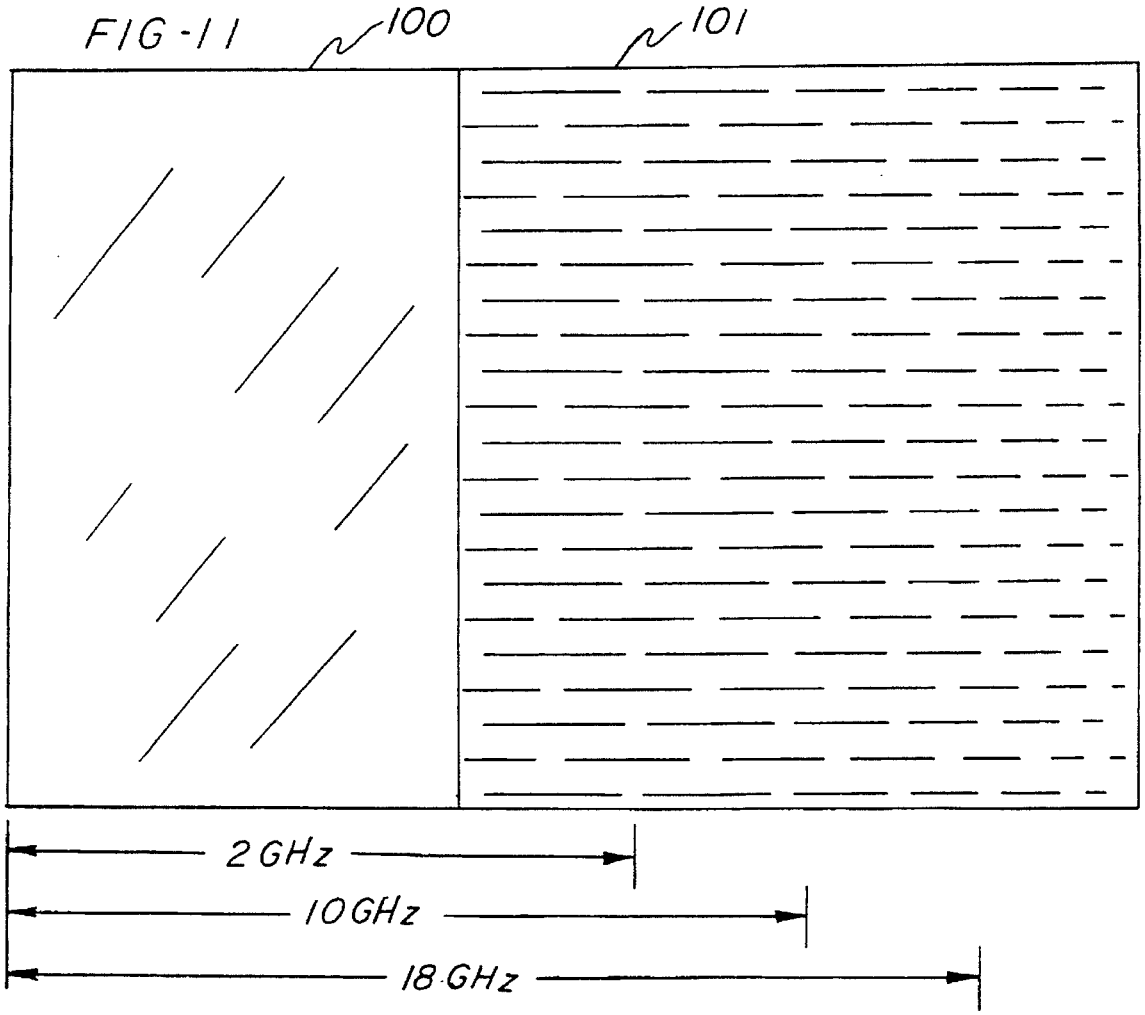
FIG. 11 is a schematic plan view showing the variation of an effective metal length which can be attained with the use of this invention.

FIG. 11 illustrates a peculiar property of a TPS. The inventors herein had tended to regard the utility of the TPS as being limited to the purposes heretofore described. As a transition element from solid metal to free space, where one would expect field perturbations and diffraction scattering, the TPS can perform a valuable service. It eliminates or nearly eliminates, the perturbations and undue visibility of the terminal edge of the metal body.

However, FIG. 11 illustrates another property of the TPS, in which it constitutes a perceived extension of physical dimensions of the metal body to which it is abutted. The TPS is frequency responsive, so that its perceived dimension actually varies with the frequency of the electromagnetic radiation that is incident upon it. This property can be exploited in a variety of broad band applications such as antennas and reflectors, and can be used on structures such as shown in FIGS. 6–10, for example.

The TPS may be thought of as a metal at its baseline edge, and as "not metal" at its terminal edge. There is then a physical point where this transition is at its halfway point (or 3 dB point), and this physical location varies with the frequency incident on it. It is effectively perceived as metal from the baseline edge to wherever the 3 dB point is. Thus, the effective metal length of the TPS varies monotonically to the frequency, and is additive to the dimensions of the solid metal body.

In FIG. 11, a metal body 100 is shown with an abutting TPS 101. The effective perceived length of their combination is shown for several frequencies. They are substantially different, and advantage can be taken of this feature in applying it to solid metal bodies.

Figure 12:
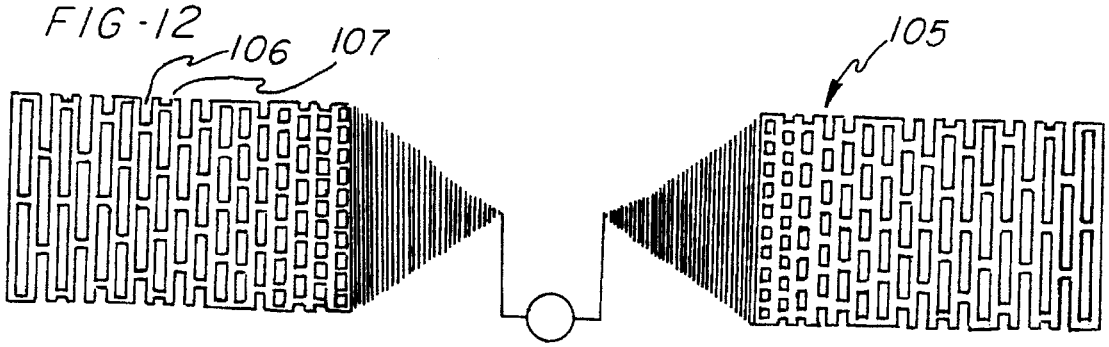
FIG. 12 is a plan view of a broadband traveling wave antenna with a tapered-slot TPS.

Here it is noted that while applied or embedded wire-like shapes are usually most convenient, it also possible to modify a metal body with slots for the same objective. FIG. 12 schematically shows a broad band travelling wave antenna 105 with tapered slots 106 in a metal plate 107, rather than similar lengths of wires on a base.

The effective length of a wire-type TPS increases with increasing frequency, while that of a slot type decreases.

The dimensions of a suitable TPS depend heavily on the specific application and the frequency range of operation. Typically, the width W of the TPS may be anywhere between about 3 and 24 inches. The element width and the width of the gaps between the elements will typically be about 0.002 inches to about 0.0020 inches for broadband applications. The length of the elements nearest the baseline edge will generally be about ½ of a wavelength or less at the center of the operating frequency band. Nearest the terminal edge, the length will be some arbitrarily small fraction of a wavelength at the highest operating frequency.

When slots are formed, the effect is like that of a superimposed orthogonal and parallel type TPS, and similar dimensions are useful.

The elements will be made of some suitable reflective metal. Copper is one suitable metal.

The substrate body will usually have a thickness between about 0.002 inches and 0.020 inches. It should have a fairly low dielectric constant and loss tangent. Suitable materials are such as fiberglass/epoxy; fiberglass/PTFE; polymide film; polyester film; and polycarbonate film.

This invention is not to be limited by the embodiments shown in the drawings and described in the description, which are given by way of example and not of limitation, but only in accordance with the scope of the appended claims.

We claim:

1. A tapered periodic surface for abutment against a baseline edge of a metal body which metal body is reflective of electromagnetic radiation, said radiation having a frequency, and which metal body at its baseline edge absent a contiguous tapered periodic surface would have a strong diffractive field at said baseline edge, said periodic surface comprising;

a substrate substantially transparent to said radiation, and having a baseline edge, and a terminal edge, and a face between said edges directly exposed to said radiation, a plurality of reflective conductive metal elements carried by said substrate on its said face, each said element having a dimension of length and width, said elements being arranged in lines, with spaces between lines and spaces between elements in each line, the length of the elements in said lines decreasing as the elements approach the terminal edge, thereby to decrease the reflected proportion of incident rays and increase the transmitted portion of incident rays, gradually from the baseline edge to the terminal edge.

2. A tapered periodic surface according to claim 1 in which said lines extend normally relative to said edges of the substrate.

3. A tapered periodic according to claim 1 in which said lines extend parallel to said edges of the substrate.

4. In combination:

a tapered periodic surface according to claim 1; and said metal body having said baseline edge, to which the baseline edge of said tapered periodic surface is contiguously abutted.

5. A combination according to claim 4 in which said lines extend normally relative to said edges of the substrate.

6. A combination according to claim 4 in which said lines extend parallel to said baseline and terminal edges.

7. A combination according to claim 4 in which said metal body is an antenna.

8. A combination according to claim 4 in which said metal body is a reflector.

9. A tapered periodic surface according to claim 1 in combination with said metal body, wherein said baseline edge of said tapered periodic surface abuts said baseline edge of said metal body and said tapered periodic surface is shaped so as to form a continuation of said metal body.

10. A tapered periodic surface for abutment against a baseline edge of a metal body which metal body is reflective of electromagnetic radiation, said radiation having a frequency, and which metal body at its baseline edge absent a contiguous tapered periodic surface would have a strong diffractive field at said baseline edge, said periodic surface comprising:

a substrate substantially transparent to said radiation, and having a baseline edge, and a terminal edge, and a face between said edges directly exposed to said radiation, a plurality of reflective conductive metal elements carried by said substrate on its said face, each said element having a dimension of length and width, said elements being arranged in lines, with spaces between lines and spaces between elements in each line, the length of the elements in said lines decreasing as the elements approach the terminal edge, thereby to decrease the reflected proportion of the incident rays and increase the transmitted portion of incident rays, gradually from the baseline edge to the terminal edge;

wherein two sets of said lines are provided, superimposed on one another, which extend normally to one another, one of which is parallel to said edges of the substrate, said lines thereby forming open slots which expose the substrate.

11. In combination:

a tapered periodic surface for abutment against a baseline edge of a metal body which metal body is reflective of electromagnetic radiation, said radiation having a frequency, and which metal body at its baseline edge absent a contiguous tapered periodic surface would have a strong diffractive field at said baseline edge, said periodic surface comprising:

a substrate substantially transparent to said radiation, and having a baseline edge, and a terminal edge, and a face between said edges directly exposed to said radiation, a plurality of reflective conductive metal elements carried by said substrate on its said face, each said element having a dimension of length and width, said elements being arranged in lines, with spaces between lines and spaces between elements in each line, the length of the elements in said lines decreasing as the elements approach the terminal edge, thereby to decrease the reflected proportion of incident rays and increase the transmitted portion of incident rays, gradually from the baseline edge to the terminal edge; and said metal body having said baseline edge, to which the baseline edge of said tapered periodic surface is contiguously abutted;

wherein two sets of said lines are provided, superimposed on one another, which extend normally to one another, one of which is parallel to said edges, said lines thereby forming open slots which expose the substrate.

* * * * *